United States Patent [19]

Hood, II

[11] Patent Number: 4,715,290

[45] Date of Patent: Dec. 29, 1987

[54] HUNTING CONTROL SIDE BEARING

[75] Inventor: Charles N. Hood, II, Deerfield, Ill.

[73] Assignee: AMSTED Industries Incorporated, Del.

[21] Appl. No.: 864,604

[22] Filed: May 19, 1986

[51] Int. Cl.[4] ..... B61F 5/14

[52] U.S. Cl. ..... 105/199.3; 267/3

[58] Field of Search ..... 105/199.2, 199.3, 171, 105/453; 267/3, 6

[56] References Cited

U.S. PATENT DOCUMENTS

| | | | |
|---|---|---|---|
| 3,402,679 | 9/1968 | Christian et al. | 105/199.1 |
| 3,915,520 | 10/1975 | Hassenauer | 105/199.3 X |
| 3,952,669 | 4/1976 | Mauzin et al. | 105/453 X |
| 4,239,302 | 12/1980 | Morris | 105/199.3 X |

FOREIGN PATENT DOCUMENTS

| | | | |
|---|---|---|---|
| 0211366 | 10/1960 | Austria | 105/171 |
| 1139429 | 1/1969 | United Kingdom | 105/453 |

*Primary Examiner*—Robert B. Reeves
*Assistant Examiner*—Scott H. Werny
*Attorney, Agent, or Firm*—Charles E. Bouton; Edward J. Brosius

[57] ABSTRACT

A side bearing for railway cars mounted horizontally between truck and body bolsters to provide frictional engagement in a substantially vertical plane and having an elastomeric member to accommodate lateral movements. The elastomeric member is a resilient cartridge which is mounted to an upstanding flange of the side bearing's base. A friction member covers the end of the elastomeric member and also attaches to the upstanding flange.

7 Claims, 7 Drawing Figures

HUNTING CONTROL SIDE BEARING

The present invention relates to improved side bearings for railway cars, and more specifically, involves an improved side bearing compressible in a direction laterally of the railway car (e.g. in a generally horizontal plane) and mounted transversely of the car.

The Prior Art

Railway cars are comprised of bodies supported on wheeled trucks which, in turn, roll on tracks. Such railway cars may be completely independent units, each supported on two separated trucks (one at each end of each car), with successive cars in a train interconnected by couplers. Also, there are articulated cars which consist of two or more full size units free to swivel with respect to one another and with the inner ends of each two adjacent units carried on a common truck.

The aforesaid trucks are comprised of opposite wheels supporting side frames that are interconnected by a lateral crosspiece called a bolster which has a centrally located center bowl. Usually, there is a carbody bolster transversely of the underside of the car frame at each end of the car also with a center plate that is seated in the center bowl of a truck bolster. The weight of each car (or unit of an articulated car) is thus supported on the center bowls of two trucks; and in the case of articulated cars, the intermediate trucks support two adjoining ends of two carbodies.

It will be understood that the trucks will turn in accord with curves in track rails and the cars will follow. Thus there will occur angular and lateral motion of the carbody bolster about the center plate and truck bolster. However, with the weight of each car or unit thus supported at two relatively small center plate areas, the cars are also subject to rocking motion from side to side and lateral motion at the center plates, particularly as the cars negotiate turns and unevenness in track rail elevation. Thus, side bearings have been provided outwardly to each lateral side of the center plates, and usually on the truck bolsters, to resist such rocking, lateral and other motions between carbody and truck bolster. Previously, the side bearings have been disposed vertically between the truck bolster and the carbody (usually the body bolster) so as to be compressed as when the body rocks toward the side bearing. That is the side bearing surfaces and friction interface with the carbody are in a horizontal plane. Such side bearing installations are more complex in articulated car structures. Prior art side bearings have been in the form of rollers, springs, friction elements and sometimes merely large flat surfaces positioned to maintain constant contact in a horizontal plane against the carbody or carbody bolster to control relative movement between body and truck. As a consequence, such side bearings have had to withstand the stress and shear of lateral and angular displacement of the bolsters and accommodate substantial vertical motion yet return accurately to a neutral position, and thus have themselves been vulnerable to wear. Most such units have involved spring loaded parts that are expensive and difficult to install and replace. Typical prior art side bearings are shown in U.S. Pat. Nos. 3,730,104 (Hood), 3,748,001 (Neumann et al), 3,897,737 (Davis) and 4,130,066 (Mulcahy).

BRIEF SUMMARY OF THE INVENTION

Accordingly, it is an object of the present invention to provide an improved resilient side bearing between a railway carbody and truck.

It is another object of the present invention to provide an improved resilient side bearing wherein the friction interface between the side bearing and the carbody lies in a nominally vertical plane.

It is a further object of the present invention to provide a side bearing capable of exercising a damping force independent of the carbody weight.

It is a still further object of the present invention to provide a side bearing which will inhibit carbody rock.

It is still another object of the present invention to provide an improved resilient side bearing comprised of an elastomeric means and a friction cover means.

It is yet another object of the present invention to provide an improved resilient side bearing which is double acting for use with articulated railway cars.

In general, the present invention is a resilient elastomeric cartridge means that is mounted horizontally on one of a railway truck bolster and body bolster and frictionally engages a vertical part extending from the other of said bolster parts. Preferably, the cartridge means has interposed thereon, adjacent the vertical part, a friction means; and in one embodiment designed for use with articulated cars, a pair of cartridge means are oppositely mounted on the truck bolster with separate friction means interposed between each cartridge means and vertical parts extending beneath the body bolster of adjacent articulated units.

BRIEF DESCRIPTION OF THE DRAWINGS

Further objects and advantages of the invention may be ascertained from the following detailed description taken in conjunction with the drawings wherein.

DETAILED DESCRIPTION OF THE INVENTION

Figure 1:
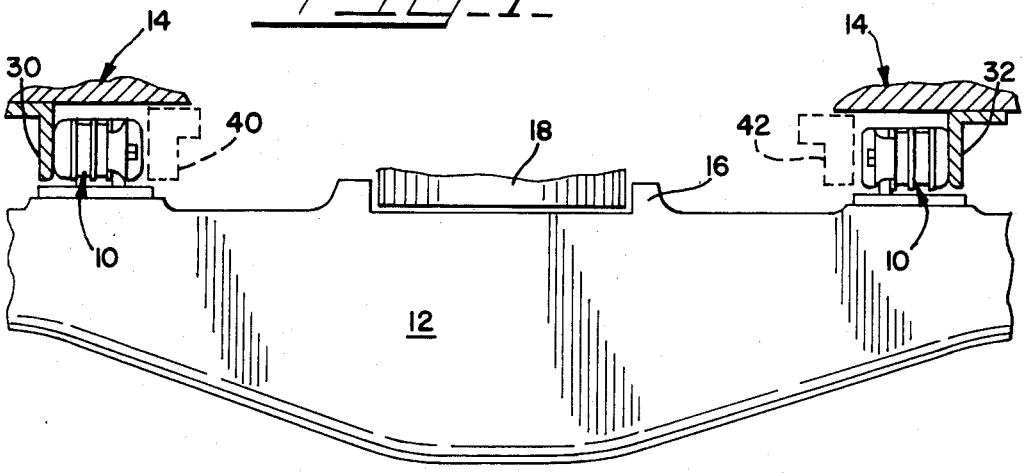
FIG. 1 is an elevation view of preferred side bearings according to the present invention in place between a truck bolster and a carbody bolster.
Figure 2:
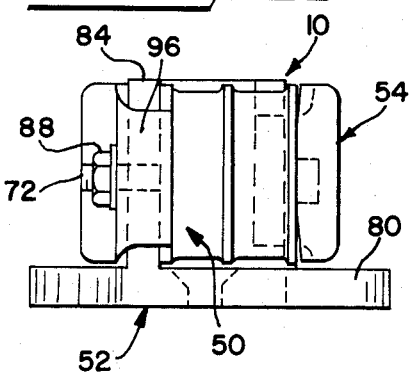
FIG. 2 is an enlarged view of the side bearing shown in FIG. 1.

As shown in FIG. 1 the side bearings, generally 10, of the present invention are located between a railway truck bolster, generally 12, (partially shown) and a carbody bolster, generally 14, (partially shown) or other fixed carbody part, and at opposite sides of the respective center bowl 16 and center plate 18.

According to the present invention the side bearings, generally 10, are disposed horizontally and longitudinally (at right angles to the main dimension of the truck bolster 12) so as to forcefully press against left outboard bracket 30 and right outboard bracket 32 (as viewed in FIG. 1) extending vertically beneath the carbody bolster 14. In the preferred embodiment illustrated for articulated cars each of the side bearings also press horizontally in opposite directions against similar left inboard bracket 40 and right inboard bracket 42 which extend vertically from beneath an adjacent articulated unit (not shown).

Each side bearing, generally 10, comprises a resilient cartridge means, generally 50, comprised of multiple layers of an elastomer, such as rubber, which is highly elastic and resilient, mounted at one end to a base plate, generally 52, (in turn secured to the truck bolster 12) and covered at the other end by a friction means, generally 54, which is substantially normal (perpendicular) to the base plate and interposed against the respective bracket 30 (or 32, 40, 42). In operation, the frictional forces between the friction means 54 and the respective bracket 30, etc. tend to resist and retard relative vertical (roll) and longitudinal (respecting the carbodies) or yawing motions whereas lateral motions respecting the carbodies are accommodated by compression of the cartridge means 50. The lateral motion is relatively small in the order of about one quarter inch, dependent upon the tolerance between bowl 16 and center plate 18.

A preferred example of a resilient cartridge generally 50 according to the present invention may be comprised of one, two or more layers of rubber shown here as 62, 64 of approximately 1¼ inch thickness. In a working embodiment each such cartridge is approximately 4 inch by 5 inch rectangular form. One rubber layer 62 is covered by a metal end piece 66 having a centrally located boss 68 extending outwardly about ⅜ inch. The opposite rubber layer 64 is covered by a similar metal end piece 70 having a centrally located threaded stud 72 extending outwardly about ¾ inch. The number thickness and composition of the rubber or elastomer layers is such as to be compressible an amount at least equal to the lateral movement expected between the center bowl and center plate parts.

The aforementioned stud 72 serves to secure the cartridge, generally 50, to the base plate, generally 52, and the boss 68 serves to properly locate the friction means, generally 54, and retain the latter from being displaced in a vertical plane from the end of the cartridge.

In embodiment illustrated, a pair of resilient cartridges, generally 50, are oppositely mounted on a single base plate 52 for use with articulated cars. It will be understood, however, that a side bearing for a non-articulated car need comprise only one such cartridge. With reference to the paired embodiment, the base plate generally 52, comprises an elongated flange 80 having at least a pair of bolt holes 82 for bolts (not shown) to secure same to a truck bolster, generally 12, and an upstanding web 84 having at least one hole 86 through which a cartridge stud 72 is passed and secured by nut 88. The base plate 52 may advantageously be a steel casting.

Figure 3:
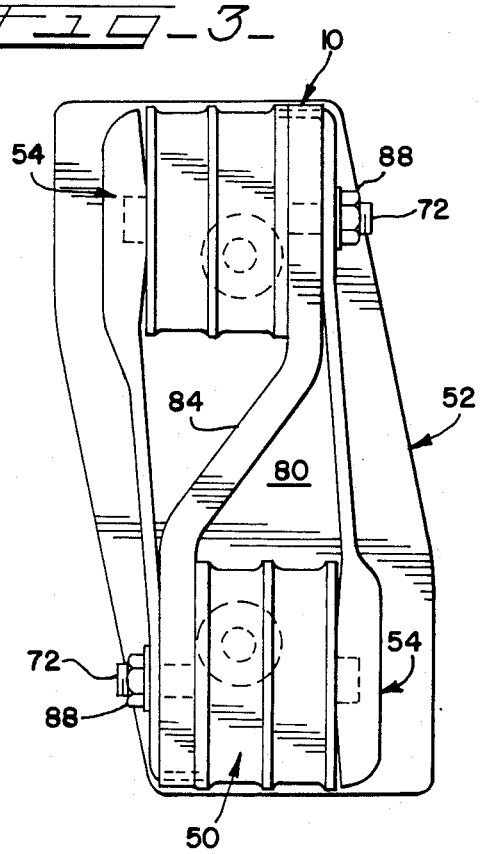
FIG. 3 is a plan view of the side bearing of FIG. 2.
Figure 4:
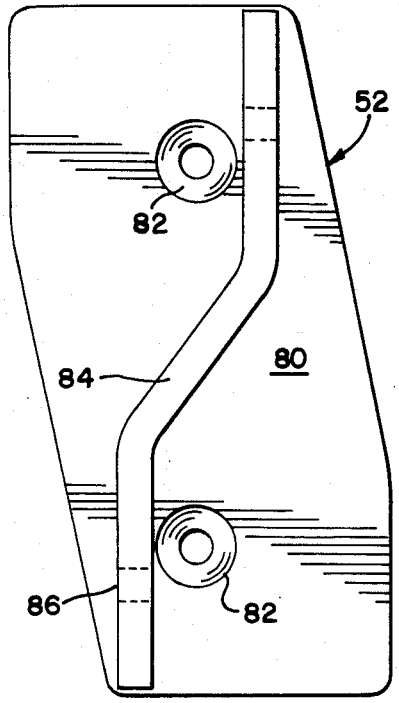
FIG. 4 is a detail plan view of a mounting bracket of the side bearing shown in FIG. 3.
Figure 5:
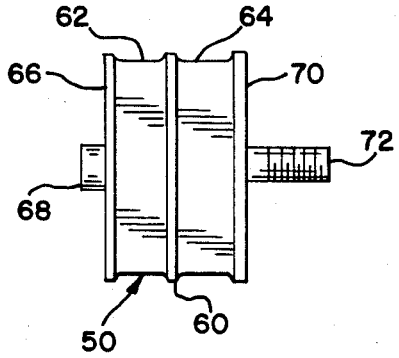
FIG. 5 is a detail view of an elastomeric cartridge means from the side bearing of FIG. 2.
Figure 6:
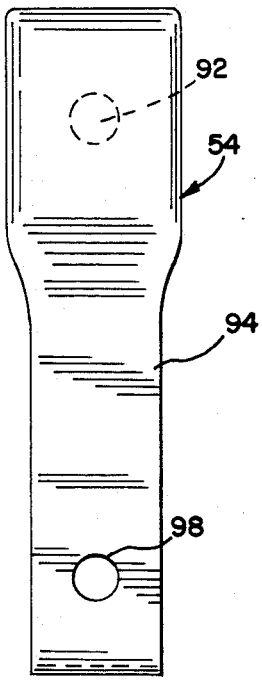
FIG. 6 is a side elevation view of a portion of the side bearing shown in FIG. 3, namely a friction means.
Figure 7:
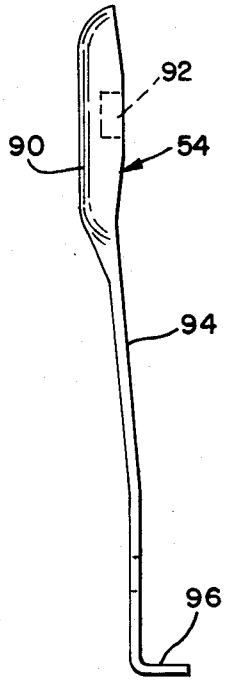
FIG. 7 is a plan view of the portion shown in FIG. 6.

The upstanding web 84 runs lengthwise end to end of flange 80 and has offset portions for securing two resilient cartridges, generally 50. As may be best seen in FIG. 3 each of the respective friction means, generally 54, is secured in place by the stud 72 and nut 88 of the opposite cartridge. That is the preferred form of friction means 54, as shown in FIGS. 6 and 7, is a replaceable part resembling a flattened spoon and may be forged from steel with a rectangular flat friction body 90 containing a pocket 92 generally corresponding to and receiving a boss 68, and corresponding to the size of the cartridge, generally 50, and a cantilever handle 94. The handle 94 is turned into a detent 96 at the end opposite the body portion 90; and the handle 94 contains a hole 98 at a distance from the detent 96 equal to the distance from and end of a web 84 to the hole 86 therein. Thus, the friction means pocket 92 may be secured in place against the boss 68 of one cartridge 50 by passing the hole 98 in the handle 94 over the stud 72 of an opposite cartridge and securing both the cartridge and handle in place with a nut 88.

It will also be understood that the preferred embodiment of a side bearing should be manufactured as shown and also as a mirror image (the web 80 oppositely angled) so as to be symmetrical when positioned at opposite sides of bolster 12 about a bolster center bowl 16 and to properly bear against the respective inboard and outboard vertical brackets of fore and aft articulated units.

Modifications and variations may be made in the aforedescribed invention without departing from the spirit and scope thereof which is defined hereafter in the claims.

What is claimed is:

1. An improved side bearing for use in railway cars in which the frictional interface between said side bearing and a part secured to one of a carbody and truck bolster takes place in one or more substantially vertical planes, said side bearing comprising a resilient cartridge means having two opposite ends, mounting means to secure one end of said cartridge with respect to one of said carbody and truck bolster, and friction means covering the other of said ends of said resilient cartridge, wherein said friction means is a fogged metal part having a handle by which it is secured substantially normal to said mounting means and a body portion held against and covering said other end of said resilient cartridge.

2. The side bearing of claim 1 wherein the resilient cartridge is comprised of an elastomeric material between two end pieces, one of said end pieces supporting a stud for securing the cartridge to said mounting means and the other of said end pieces supporting a boss for locating the said friction means.

3. The side bearing of claim 1 wherein a pair of said resilient cartridges are secured to said mounting means extending in opposite directions therefrom and including a pair of said friction means, one such friction means covering said other end of each of said cartridges whereby to be positioned between a truck and adjacent ends of articulated car units.

4. An improved side bearing for use in articulated railway cars in which the frictional interface between said side bearing and a part secured to one of a carbody and truck bolster takes place in one or more substantially vertical planes and wherein each side bearing is positioned on one of said carbody and truck bolster to contact a part positioned on the other of said carbody and truck bolster whereby to control relative motion between said truck bolster and carbody, said side bearing comprising: a base plate having a flange for securing to one of a truck bolster and carbody and an upstanding web; a first resilient cartridge means having two opposite ends, said first cartridge means being fastened at one end to one side of said web at a first location and extending in a given direction from said web; a second resilient cartridge means having two opposite ends, said second cartridge means being fastened at one end to an opposite side of said web at a second location spaced from said first location, and extending oppositely to said given direction; and first and second friction means covering the other respective ends of said first and second resilient cartridge means, each of said friction means being positioned substantially normal to said flange and fastened to said web.

5. The side bearing of claim 4 wherein each resilient cartridge means is comprised of an elastomeric material between two end pieces, one of said end pieces supporting a stud for securing the cartridge to said web and the other of said end pieces supporting a boss for locating the said friction means.

6. The side bearing of claim 5 wherein each of said first and second friction means is a forged metal part having a substantially flat body held against said boss of one of said first and second cartridges, and a cantilever handle extending from said body to said web and being fastened thereto on the stud of the other of said first and second cartridge means.

7. An improved system of side bearing and means for mounting on a railway car between the carbody and the bolster of a car truck said system comprising in combination: a side bearing having a resilient cartridge means secured on one end by mounting means on said bolster of a car truck and extending in a horizontal direction transverse to said carbody so as to position a friction face at an other end at right angles to the main dimension of said bolster; and a bracket secured to said carbody and extending vertically beneath said body at a location to interface vertically with said friction face, wherein said friction face is a forged metal part having a handle by which it is secured to said mounting means and a body portion held against and covering said other end of said resilient cartridge.

* * * * *